US011221588B2

(12) United States Patent
Erard

(10) Patent No.: US 11,221,588 B2
(45) Date of Patent: Jan. 11, 2022

(54) STRUCTURE FOR A FRAGILE DIAL

(71) Applicant: Omega SA, Biel/Bienne (CH)

(72) Inventor: Bastien Erard, Les Breuleux (CH)

(73) Assignee: Omega SA, Biel/Bienne (CH)

( * ) Notice: Subject to any disclaimer, the term of this patent is extended or adjusted under 35 U.S.C. 154(b) by 630 days.

(21) Appl. No.: 16/164,140

(22) Filed: Oct. 18, 2018

(65) Prior Publication Data

US 2019/0163138 A1 May 30, 2019

(51) Int. Cl.

| | |
|---|---|
| ***G04B 19/14*** | (2006.01) |
| ***G04B 19/12*** | (2006.01) |
| ***G04B 45/00*** | (2006.01) |

(52) U.S. Cl.

CPC ..... *G04B 19/14* (2013.01); *G04B 19/12* (2013.01); *G04B 45/0015* (2013.01)

(58) Field of Classification Search

CPC ..... G04B 19/06; G04B 19/065; G04B 19/12; G04B 19/14

See application file for complete search history.

(56) References Cited

U.S. PATENT DOCUMENTS

| | | | | |
|---|---|---|---|---|
| 3,786,627 A | | 1/1974 | Takagi et al. | |
| 5,825,722 A | * | 10/1998 | Meyrat | G04B 37/05 368/276 |
| 5,966,344 A | * | 10/1999 | Umemoto | G04B 19/12 368/227 |

FOREIGN PATENT DOCUMENTS

| | | | |
|---|---|---|---|
| CH | 182122 | | 1/1936 |
| CH | 329446 | | 4/1958 |
| CH | 700 664 | A2 | 9/2010 |
| CN | 204759038 | U | 11/2015 |
| FR | 2 162 349 | A1 | 7/1973 |
| JP | S5590970 | U * | 6/1980 |

OTHER PUBLICATIONS

English Translation of JPO Office Action (Year: 2019).*

European Search Report dated May 18, 2018 in European application 17203954.7, filed on Nov. 28, 2017 (with English Translation of Categories Cited Documents).

* cited by examiner

*Primary Examiner* — Edwin A. Leon

*Assistant Examiner* — Jason M Collins

(74) *Attorney, Agent, or Firm* — Oblon, McClelland, Maier & Neustadt, L.L.P.

(57) ABSTRACT

A dial to be mounted in a watch case includes a first support plate and a second fragile plate, the two plates defining a horizontal plane and being bonded one on top of the other in a vertical direction relative to the horizontal plane. The second plate has a smaller section in the horizontal plane than the section of the first plate in order to leave free on the first plate a peripheral rim to be mounted with play inside the watch case.

18 Claims, 2 Drawing Sheets

STRUCTURE FOR A FRAGILE DIAL

CROSS-REFERENCE TO RELATED APPLICATION

This application claims priority of European Patent Application No. 17203954.7 filed on Nov. 28, 2017 the entire disclosure of which is incorporated herein by reference.

FIELD OF THE INVENTION

The present invention relates to the field of horology and more specifically to a structure for a dial made of a fragile material. It also relates to the arrangement of this dial in a watch.

BACKGROUND OF THE INVENTION

Watch dials can be made of materials such as mother-of-pearl, aventurine, etc., which have an attractive aesthetic appearance but have the drawback of being fragile. Consequently, they are liable to break or crack when the watch to which they are fitted is subjected to a shock, for example if the watch is dropped onto a hard floor. Hence, these watches cannot satisfy the requirements for shock resistance governed by Swiss watch industry standard NIHS 91-10.

In a conventional structure represented in FIG. 1, the dial 2 comprises two plates 3, 4 bonded one on top of the other, with a support plate 3 made of a metal material such as brass and a plate 4, which is visible through the crystal 5 and made of the fragile material in question. In this structure, the two plates have the same diameter and are delimited by axially aligned edges. These edges are mounted facing the collar 7*a* of the case middle 7 with play intended to absorb radial shocks. The alignment of the edges means that the plates are mounted facing the case middle with the same play, with the result that, in the event of a radial shock, the two plates butt against the case middle. Further, fragile plate 4 is mounted facing flanged bezel 6 with play intended to absorb vertical shocks. This means that, in the event of a shock, it is the fragile plate that collides with the bezel. It is thus evident that the drawback of this structure is that, in the event of a radial or vertical shock, the fragile plate is stressed as much as or even more than the support plate, which means it is liable to crack or break.

SUMMARY OF THE INVENTION

To overcome the aforecited drawback, it is an object of the present invention to propose a new dial structure allowing stress on the fragile plate to be reduced in the event of a shock, be it radial or vertical.

To this end, the present invention proposes a dial formed of two plates of different dimensions joined together, with a support plate having a larger dimension than that of the fragile plate so as to leave free on the support plate a peripheral rim intended to be mounted in a vertical direction relative to the bezel in place of the peripheral rim of the fragile plate.

The present invention also concerns a watch, typically a wristwatch.

Thus, in case of vertical shock, it is the support plate that butts against the bezel whereas the fragile plate can move along the same path without encountering any obstacle. It follows that the risk of cracking or breaking the fragile plate is greatly reduced.

In this new dial structure, the respective edges of the plates are not vertically aligned. This makes it possible to mount the dial in the watch case with distinct radial play for each plate. It is thus possible to mount the edge of the fragile plate with a greater radial clearance than that for the edge of the support plate so that, in the event of a radial shock, it is only the edge of the support plate that butts against the case. Again, it follows that the fragile plate will not be subjected to any significant stress in the event of a radial shock.

Other advantages will appear from the features set out in the claims, and from the detailed description of the invention illustrated hereinafter with reference to the annexed drawings, provided as non-limiting examples.

DETAILED DESCRIPTION OF THE INVENTION

Figure 1:
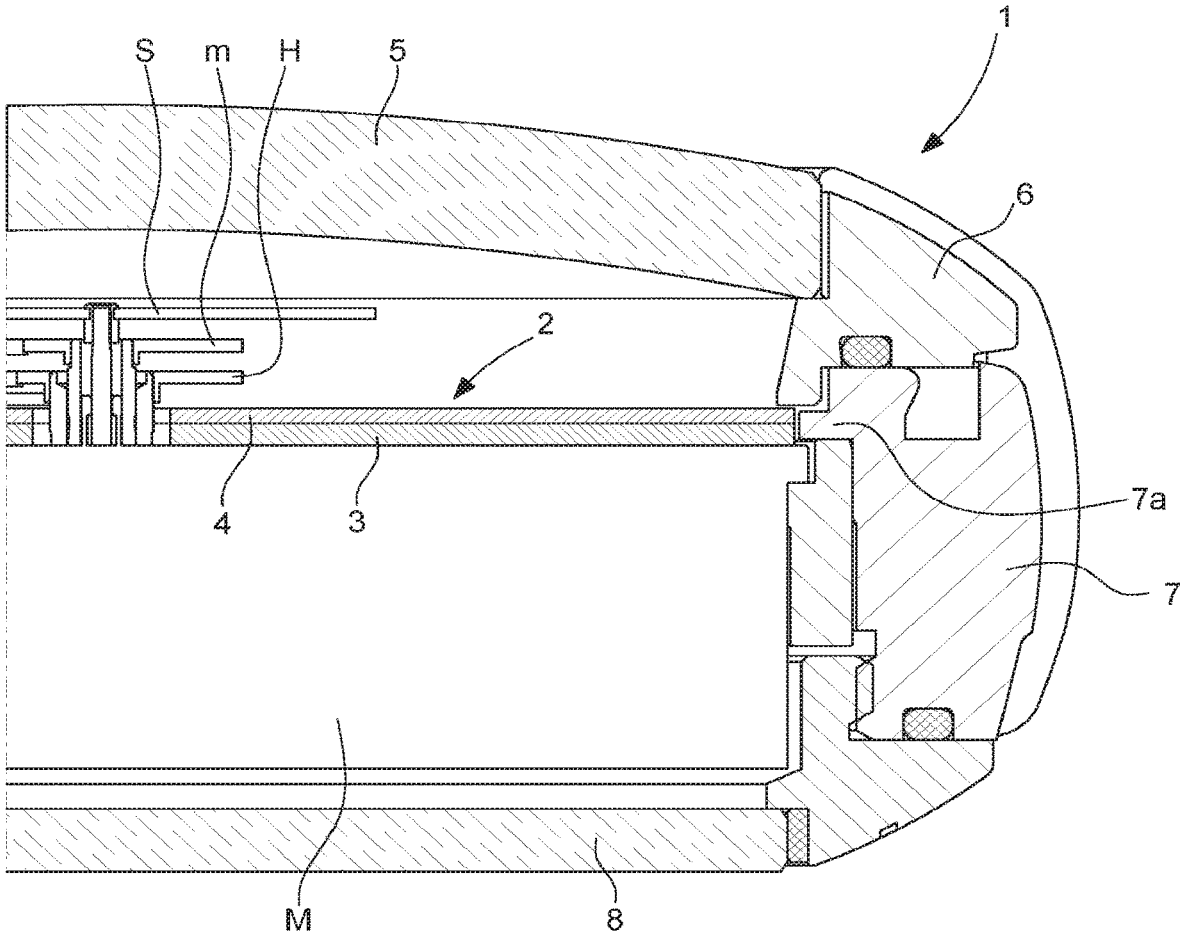
Fig. 1 ( Prior Art )
FIG. 1 represents a partial cross-sectional view of a prior art structure of a fragile dial arranged in the watch case.
Figure 2A:
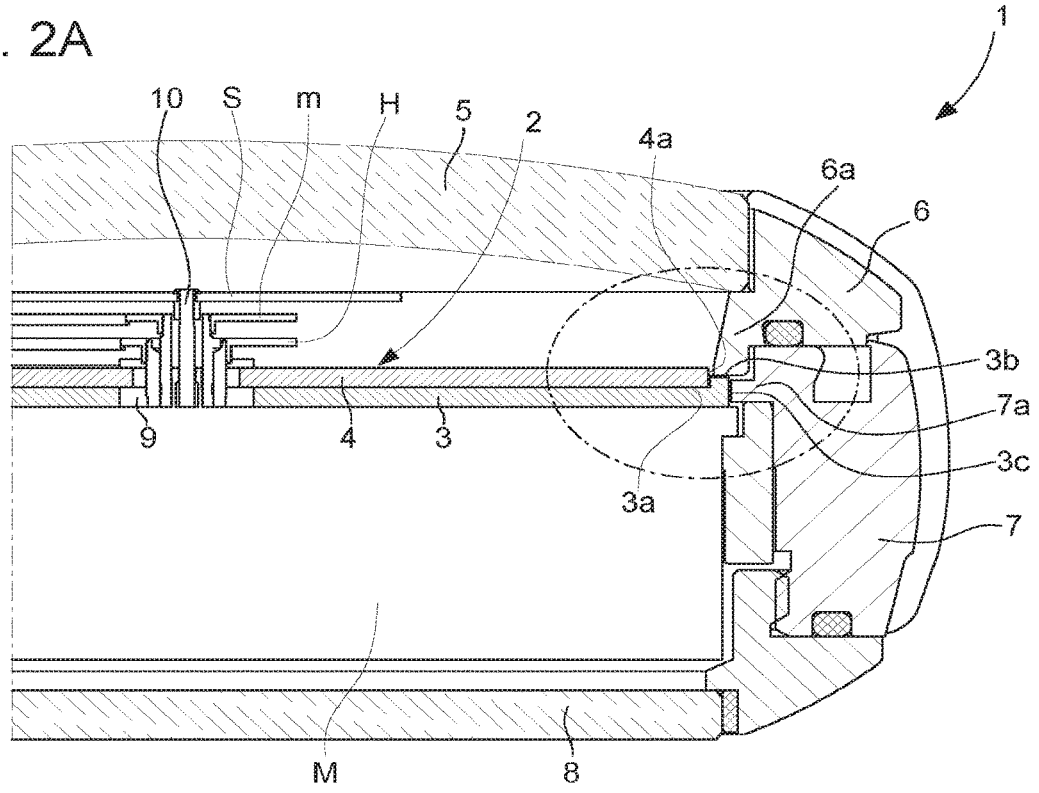
FIG. 2A represents a partial cross-sectional view of a structure according to the invention of a fragile dial arranged in the watch case.
Figure 2B:
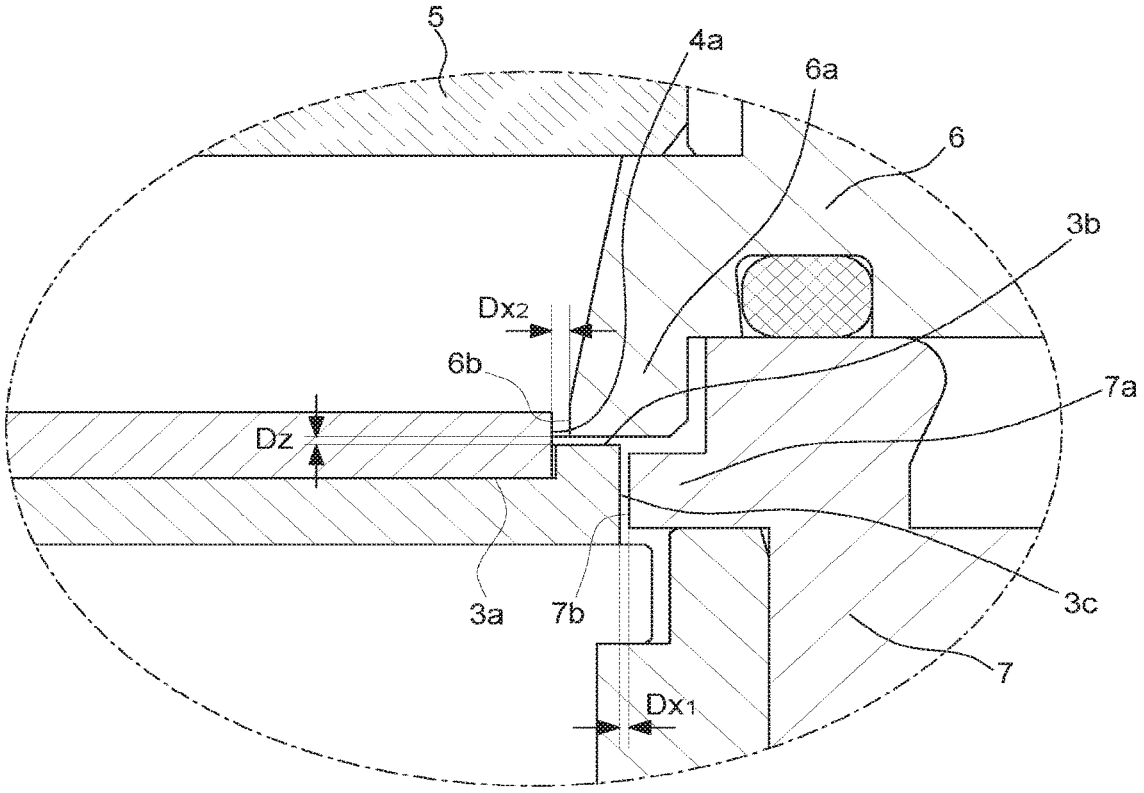
FIG. 2B is an enlargement of FIG. 2A.

The present invention relates to a dial structure and to the arrangement thereof in a watch case comprising a timepiece movement M surmounted by a dial 2 above which move the hour hand H, minute hand m and seconds hand S driven by movement M. Referring to FIGS. 2A and 2B, dial 2 is formed of two plates bonded to each other, with a support plate 3 preferably made of a metal material such as brass and a plate 4 made of the fragile material. A 'fragile' material means any material liable to break/crack and not to deform under impact or, in other words, a material exhibiting no plastic deformation under stress. To cite a few examples, the material may be a variety of quartz which is aventurine, mother-of-pearl, ceramic, silicon, etc. Plates 3 and 4 are advantageously bonded by means of a double-sided adhesive tape (not represented) placed between them. The use of such a tape makes it possible to ensure that the plates are properly held together while allowing a connection capable of absorbing any shocks to which the metal plate is subjected.

In a conventional manner, watch case 1 includes a crystal 5, a back cover 8 and a joining element between crystal 5 and back cover 8 realized in one or more parts and including a bezel 6, a flange 6*a* and a case middle 7. Fragile plate 4 is arranged on the crystal 5 side and support plate 3 is arranged on the back cover 8 side of watch case 1. The support plate and the fragile plate define a horizontal plane, with the plates being disposed one on top of the other in a direction perpendicular to this plane, i.e. in a vertical direction. In a conventional manner, support plate 3 and fragile plate 4 are pierced with openings 9 for the passage of the hand arbor 10. Further, support plate 3 could be hollow in the centre.

According to the invention, fragile plate 4 has a surface area that is smaller than that of support plate 3 and which, in vertical projection onto support plate 3, does not go beyond the outer edge of the latter, so as to leave free on support plate 3 a peripheral rim 3*b* intended to be mounted facing a wall of the joining element and, more specifically, flange 6*a* which is integral with bezel 6 in the illustrated example.

This rim 3*b* is dimensioned to be largely concealed by the flange from the exterior of the crystal. It is substantially horizontal and intended to be mounted facing a complementary surface of flange 6*a* with play Dz allowing vertical shocks to be absorbed. This play Dz is substantially constant and comprised between 0.01 and 0.1 mm and preferably between 0.03 and 0.07 mm.

Peripheral rim 3*b* extends as far as edge 3*c* of support plate; edge 3*c* is substantially vertical and intended to be mounted facing another wall of the joining element with play $Dx_1$, to absorb radial shocks. More precisely, edge 3*c* is mounted facing a wall 7*b* of complementary shape (in this case straight and perpendicular to the plane of dial 2) of internal collar 7*a* of case middle 7.

The two plates are arranged substantially concentrically relative to the central arbor 10 of the case which is the hand arbor. Thus, in the case of a circular dial, the fragile plate has a smaller diameter than the diameter of the support plate and the peripheral rim forms a ring of constant width around the fragile plate.

According to the preferred variant represented in FIGS. 2A and 2B, support plate 3 includes a housing 3*a* inside which fragile plate 4 is secured. This housing has a substantially complementary shape to that of the support plate. Preferably, it has a depth that is smaller than the thickness of the fragile plate so that one portion of edge 4*a* of fragile plate 4 stands proud of housing 3*a*. It is also possible to envisage housing 3*a* having a depth substantially equal to the thickness of fragile plate 4 in which case peripheral rim 3*b* and the upper face of fragile plate 4 are in substantially the same plane. In such case, fragile plate 4 is thus entirely contained within support plate 3.

According to another variant that is not represented, the support plate is devoid of a housing and fragile plate 4 is superposed on support plate 3 while leaving a peripheral rim 3*b* of support plate 3 free for assembly facing flange 6*a*.

According to yet another variant (not represented), support plate 3 is hollow in the centre and forms a frame comprising an inner rim defined by an inner peripheral bottom portion of housing 3*a*.

Referring to the preferred variant of FIGS. 2A and 2B, at least one portion of edge 4*a* of fragile plate 4 stands proud vertically of peripheral rim 3*b*. This portion is mounted facing a vertical wall of the joining element, and more precisely a vertical wall 6*b* of flange 6*a* It is mounted with substantially constant play $Dx_2$. According to the invention, play $Dx_2$ is greater than play $Dx_1$ so that, in the event of radial shock, support plate 3 butts against wall 7*b* of collar 7*a* without edge 4*a* of fragile plate 4 colliding with wall 6*b* of flange 6*a*. $Dx_2$ is chosen to be greater than $Dx_1$ yet sufficiently small to be barely perceptible or even invisible to the naked eye through the crystal. Thus, preferably, $Dx_2$ is comprised between 0.05 and 0.15 mm and $Dx_1$ is comprised between 0.01 and 0.1 mm with $Dx_2 > Dx_1$. More preferably, $Dx_2$ is comprised between 0.08 and 0.12 mm and $Dx_1$ is comprised between 0.03 and 0.07 mm (idem). Advantageously, the surface of the peripheral rim of the support plate and/or flange wall 6*b* are coated with a dark-coloured layer.

Likewise, when the support plate is superposed on the fragile plate, the edge of the fragile plate is mounted with play $Dx_2$ greater than $Dx_1$.

Finally, if the fragile plate is entirely contained within the support plate housing, only the latter is stressed during a radial shock.

LIST OF PARTS (1) Watch case
(2) Dial
(3) Support plate, also called first plate
  a. Housing
  b. Peripheral rim
  c. Edge
(4) Fragile plate, also called second plate
  a. Edge
(5) Crystal
(6) Bezel
  a. Flange
(7) Case middle
  a. Internal collar
(8) Back cover
(9) Openings for the passage of the hands
(10) Hand arbor
$D_x$: Horizontal play, also called radial play
$D_z$: Vertical play

The invention claimed is:

1. A dial being mounted in a watch case, the dial comprising:

a first support plate and a second plate made of a fragile material, the two plates defining a horizontal plane and being bonded one on top of the other substantially concentrically in a vertical direction relative to the horizontal plane, each plate being delimited by an edge, the edge of the first plate forming a first assembly surface of the dial intended to be mounted with play inside the watch case, wherein the second plate has a smaller surface area than the surface area of the first plate and which, in vertical projection onto the first plate does not go beyond the outer edge of the first plate so as to leave free on the first plate a peripheral rim, said peripheral rim forming a second assembly surface of the dial intended to be mounted with play inside the watch case, and wherein at least one portion of the edge of the second plate stands proud in the vertical direction of the peripheral rim of the first plate, said at least one portion of the edge forming a third assembly surface of the dial intended to be mounted with play inside the watch case.

2. The dial according to claim 1, wherein the second plate is superposed on the first support plate such that the entire edge of the second plate stands proud in the vertical direction of the peripheral rim of the first plate.

3. The dial according to claim 1, wherein the first support plate includes a housing inside which the second plate is bonded, the housing being framed by the peripheral rim, the depth of the housing being smaller than the thickness of the edge of the second plate so that said portion of the edge of the second plate stands proud in the vertical direction of the peripheral rim of the first plate.

4. The dial according to claim 3, wherein the housing has a substantially complementary shape to that of the second plate.

5. The dial according to claim 1, wherein the first support plate includes a housing inside which the second plate is bonded, the housing being framed by the peripheral rim, the depth of the housing being substantially equal to the thickness of the edge of the second plate so that the entire edge is contained within the first plate.

6. The dial according to claim 1, wherein the first support plate is made of a metal material and the second plate is made of a fragile material selected from the list including mother-of-pearl, quartz including aventurine, ceramic and silicon.

7. The dial according to claim 6, wherein the metal material of the first support plate is brass.

8. A watch comprising a case delimiting a volume inside which is mounted the dial according to claim 1, the case being provided with a back cover, with a crystal and with a joining element between the back cover and the crystal made in one or more parts and including a case middle, the first support plate being arranged on the back cover side and the second plate being arranged on the crystal side, the first assembly surface of the dial being mounted in the horizontal plane direction facing a first wall of the joining element with play Dx1 intended to absorb horizontal shocks, wherein, in the vertical direction, the second assembly surface of the dial is mounted facing a second wall of the joining element with play Dz such that, during vertical shocks, only the first support plate of the dial butts against the joining element.

9. The watch according to claim 8, wherein at least one portion of the edge of the second plate stands proud in the vertical direction of the peripheral rim of the first plate, said at least one portion of the edge forming a third assembly surface of the dial intended to be mounted with play inside the watch case, and wherein the third assembly surface of the dial is mounted in the horizontal plane direction facing a third wall of the joining element with play Dx2, play Dx2 being greater than play Dx1, so that, during horizontal shocks, only the support plate of the dial butts against the joining element.

10. The watch according to claim 9, wherein Dx2 is substantially constant and comprised between 0.05 and 0.15 mm and Dx1 is substantially constant and comprised between 0.01 and 0.1 mm.

11. The watch according to claim 9, further comprising a flange arranged between the crystal and the dial, wherein the third wall is a substantially vertical wall of the flange.

12. The watch according to claim 9, wherein Dx2 is substantially constant and comprised between 0.08 and 0.12 mm and Dx1 is substantially constant and comprised between 0.03 and 0.07 mm.

13. The watch according to claim 8, wherein Dz is substantially constant and comprised between 0.01 and 0.1 mm.

14. The watch according to claim 8, wherein the first wall is a substantially vertical wall of the case middle.

15. The watch according to claim 8, further comprising a flange arranged between the crystal and the dial, wherein the second wall is a substantially horizontal wall of the flange.

16. The watch according to claim 8, further comprising a flange arranged between the crystal and the dial, wherein the peripheral rim is dimensioned to be largely concealed by the flange from the exterior of the watch through the crystal.

17. The watch according to claim 8, wherein Dz is substantially constant and comprised between 0.03 and 0.07 mm.

18. A dial being mounted in a watch case, the dial comprising:

a first support plate and a second plate made of a fragile material, the two plates defining a horizontal plane and being bonded one on top of the other substantially concentrically in a vertical direction relative to the horizontal plane, each plate being delimited by an edge, the edge of the first plate forming a first assembly surface of the dial intended to be mounted with play inside the watch case, wherein the second plate has a smaller surface area than the surface area of the first plate and which, in vertical projection onto the first plate does not go beyond the outer edge of the first plate so as to leave free on the first plate a peripheral rim, said peripheral rim forming a second assembly surface of the dial intended to be mounted with play inside the watch case, and wherein the first support plate is made of a metal material and the second plate is made of a fragile material selected from the list including mother-of-pearl, quartz including aventurine, ceramic and silicon.

* * * * *